US007292703B2

(12) United States Patent
Kaulfuss et al.

(10) Patent No.: US 7,292,703 B2
(45) Date of Patent: Nov. 6, 2007

(54) HEADPHONES

(75) Inventors: Johannes Kaulfuss, Fredriksberg C (DK); Axel Grell, Burgdorf (DE)

(73) Assignee: Sennheiser Electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 10/505,255

(22) PCT Filed: Feb. 20, 2003

(86) PCT No.: PCT/EP03/01729

§ 371 (c)(1),
(2), (4) Date: May 23, 2005

(87) PCT Pub. No.: WO03/071830

PCT Pub. Date: Aug. 28, 2003

(65) Prior Publication Data

US 2005/0244027 A1 Nov. 3, 2005

(30) Foreign Application Priority Data

Feb. 21, 2002 (DE) ..... 102 07 214

(51) Int. Cl.
*H04R 25/00* (2006.01)

(52) U.S. Cl. ..... 381/370; 381/374; 381/383

(58) Field of Classification Search ..... 381/309, 381/370, 371, 374, 376–380, 383; 181/129, 181/130, 135; 379/430; 2/209, 430, 906; 128/866

See application file for complete search history.

(56) References Cited

U.S. PATENT DOCUMENTS 4,409,442 A * 10/1983 Kamimura ..... 381/383
4,445,005 A 4/1984 Furuhashi
4,463,223 A 7/1984 Yamanoi et al.
4,517,418 A 5/1985 Baran et al.
4,597,469 A 7/1986 Nagashima

FOREIGN PATENT DOCUMENTS

| | | |
|---|---|---|
| DE | 31 18 294 | 12/1985 |
| DE | 197 24 667 | 10/1998 |
| EP | 0 994 636 | 4/2000 |

* cited by examiner

*Primary Examiner*—Huyen Le
(74) *Attorney, Agent, or Firm*—Reed Smith LLP

(57) ABSTRACT

According to the invention a headphone set comprises a hoop band, to each of the two ends of which is fixed a respective acoustic transducer and which extends accurately in a plane, with at least one joint for folding the ends of the hoop band inwardly in the plane and an elastic region for resiliently expanding and narrowing the hoop band is either characterized in that the fixing of each of the transducers to the ends of the hoop band has a joint for pivoting the transducers into the plane and that arranged in the region of the two ends of the hoop band is a respective connecting structure which can be connected to each other and which then in co-operating relationship hold the folded-in ends of the hoop band in a crossed position or that the one joint for folding the ends of the hoop band inwardly is arranged at the apex of the hoop band, that the headphone set is of mirror image symmetry about a plane and that the fixing of each of the transducers to the ends of the hoop band has a joint for pivoting the transducers into the plane of symmetry which is at a right angle to the plane of the hoop band.

1 Claim, 4 Drawing Sheets

HEADPHONES

CROSS-REFERENCE TO RELATED APPLICATIONS

This application claims priority of International Application PCT/EP03/01729, filed Feb. 20, 2003 and German Application 102 07 214.0, filed Feb. 21, 2002, the complete disclosures of which are hereby incorporated by reference.

BACKGROUND OF THE INVENTION a) Field of the Invention

The present invention concerns a headphone set comprising a hoop band, to each of the two ends of which is fixed a respective acoustic transducer and which extends accurately in a plane, with a joint for folding the ends of the hoop band inwardly in the plane and an elastic region for resiliently expanding and narrowing the hoop band.

b) Description of the Related Art

Headphone sets which can be folded together are known. They generally have at least one joint in the hoop band region and often have a respective joint in the regions of the temples of the head in the hoop band and also telescopic hoop band portions which when retracted shorten the hoop band and which when extended serve for adjusting the position of the acoustic transducers of the headphone set to the ear and the head of the user.

When the known headphone sets have been folded together, the user often wraps the cables of the acoustic transducers around the headphone set in the folded-together condition, so that the headphone set does not become unfolded again.

In that situation or at the latest when the cables are unwound again, they often become tangled and knotted. However, without the cables being wound around the known foldable headphone sets, they usually do not reliably remain in their position of being folded together. That also results in particular in difficulties when stowing the folded-together headphone set, more specifically this being a situation in which the headphone set can undesirably become unfolded again. In addition, upon being removed from any relatively narrow case, the headphone set then has a tendency to become unintentionally unfolded whereby it has a tendency to become hooked up and possibly bent or broken.

An embodiment by way of example of a headphone set of the above-described kind can be found for example in DE 31 18 294 C2. The headphone set described in that publication has a central joint which is disposed at the center of the hoop band and by which the headphone set can be folded together in such a way that the ear pieces of the acoustic transducers lie flat again each other.

Another example of a known headphone set is disclosed in U.S. Pat. No. 4,517,418. The headphone set disclosed therein has two joints which are arranged in the hoop bands and about which the ends thereof can be folded inwardly in such a way that the transducers come to lie within the arc of the hoop band.

OBJECT AND SUMMARY OF THE INVENTION

The primary object of the present invention is to provide a headphone set which can be folded together and the handling of which is simpler and less susceptible to trouble.

In accordance with the invention that is attained by a headphone set comprising a hoop band having two ends; an acoustic transducer is fixed to each of the two ends respectively. The hoop band extends accurately in a plane and has at least one joint for folding the ends of the hoop band inwardly in the plane and an elastic region for resiliently expanding and narrowing the hoop band. The fixing of each of the transducers to the ends of the hoop band have a joint for pivoting the transducers into the plane. A respective connecting structure is arranged in the region of the two ends of the hoop band, each such structure being able to be connected to each other and which then in Co.-operating relationship hold the folded-in ends of the hoop band in a crossed position.

A headphone set has a hoop band, to each of the two ends of which is fixed a respective acoustic transducer. The hoop band extends accurately substantially in a plane and has at least one joint for folding the hoop band ends inwardly in the plane. As is known, that causes a reduction in the width of the hoop band and thus reduces the amount of space that it requires. In addition the hoop band has an elastic region for resilient expansion and constriction of the hoop band. Resilient expansion provides for example for clamping the headphone set on the head of its user in such a way that the acoustic transducers bear against the ears of the user. In accordance with the invention the fixing of each of the transducers to the ends of the hoop band has a joint. The transducers can be pivoted into the plane of the hoop band by means of that joint. In that way they project out of the plane of the hoop band to a lesser degree than for example in a position in which they are disposed substantially at a right angle to the plane of the hoop band and in which they are adapted to the anatomy of the head and ears, and therefore they can form a flat unit with the hoop band of the headphone set. In addition a respective connecting structure is disposed in the region of each of the two ends of the hoop band. When the ends of the hoop band are folded inwardly the connecting structures can be connected together and then hold the ends of the hoop band in crossed-over relationship by Co.-operation thereof. That therefore affords overall a flat stable unit for the folded-together headphone set, and that is prevented from being unfolded by mistake, by virtue of the connecting structures.

The transducer fixing joint is preferably a ball joint for adjustment of the transducers and in particular the earpiece surface thereof to the anatomy of the ear of a person wearing the headphone set, usually substantially at a right angle to the plane of the hoop band, and the ball joint is additionally preferably pivotable through about 90° in order to be able to pivot the transducers into the plane of the hoop band.

The connecting structures in the ends of the hoop band are preferably openings in the hoop band ends, which can be fitted one into the other when the hoop band ends are crossed over. For that purpose the openings are arranged in anti-symmetrical relationship at mutually oppositely disposed sides of the hoop band ends. The openings are preferably so designed that the hoop band ends when clasped together are disposed flush in one plane. In particular to ensure that the openings or other connecting structures according to the invention do not unintentionally come loose from each other again, the connecting structures are arranged in such a way that they can be connected only when the hoop band is elastically constricted and the biasing force of the elastic constriction then produces a connecting force. Particularly in the positively locking configuration of the connecting structures, for example in the form of the openings, that involves a force which causes tilting of the interengaging connecting structures, in particular the openings which are fitted one into the other.

Thus, in accordance with the invention, there is preferably provided a folded-together headphone set with transducers which are pivoted into the plane of the hoop band and hoop band ends which are held in crossed relationship, in the form of a flat unit in which the transducers are preferably disposed in the plane in a condition of directly adjoining each other in mutually juxtaposed relationship.

An alternative way of attaining the object of the invention involves a headphone set with a hoop band, to each of the two ends of which is fixed an acoustic transducer and which extends accurately in a plane, with at least one joint for folding the ends of the hoop band inwardly in the plane and an elastic region for resilient expansion and constriction of the hoop band, wherein in accordance with the invention a hoop band joint is disposed at the apex of the headphone set which is of mirror image symmetry in order to fold the hoop band ends inwardly towards each other. In addition the fixing of each of the transducers to the ends of the hoop band of that headphone set has a joint for pivotal movement of the transducers into the plane of symmetry. There, the transducers can then bear in flush relationship directly against each other and can thus form a compact unit, together with the halves of the hoop band, which are folded towards each other. To prevent the headphone set from unintentionally becoming unfolded, the headphone set, in the region of the ends of the hoop band and/or preferably in the region of the transducers, may have a connecting structure which when connected together hold the acoustic transducers that bear against each other in position.

The present invention will be described hereinafter with reference to the accompanying drawings.

DESCRIPTION OF THE PREFERRED EMBODIMENTS

Figure 1:
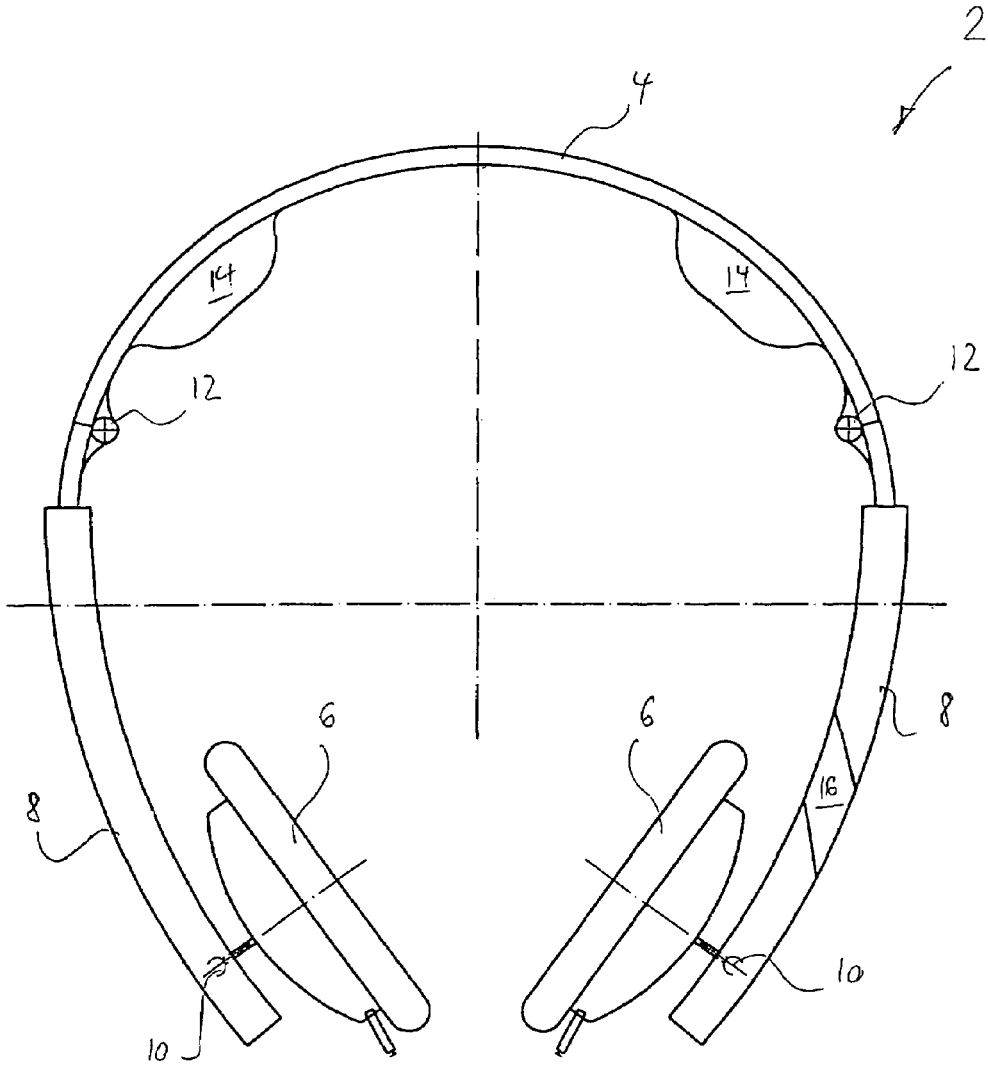
FIG. 1 shows a front view of a headphone set according to the invention in the deployed position which is ready for use.
Figure 2:
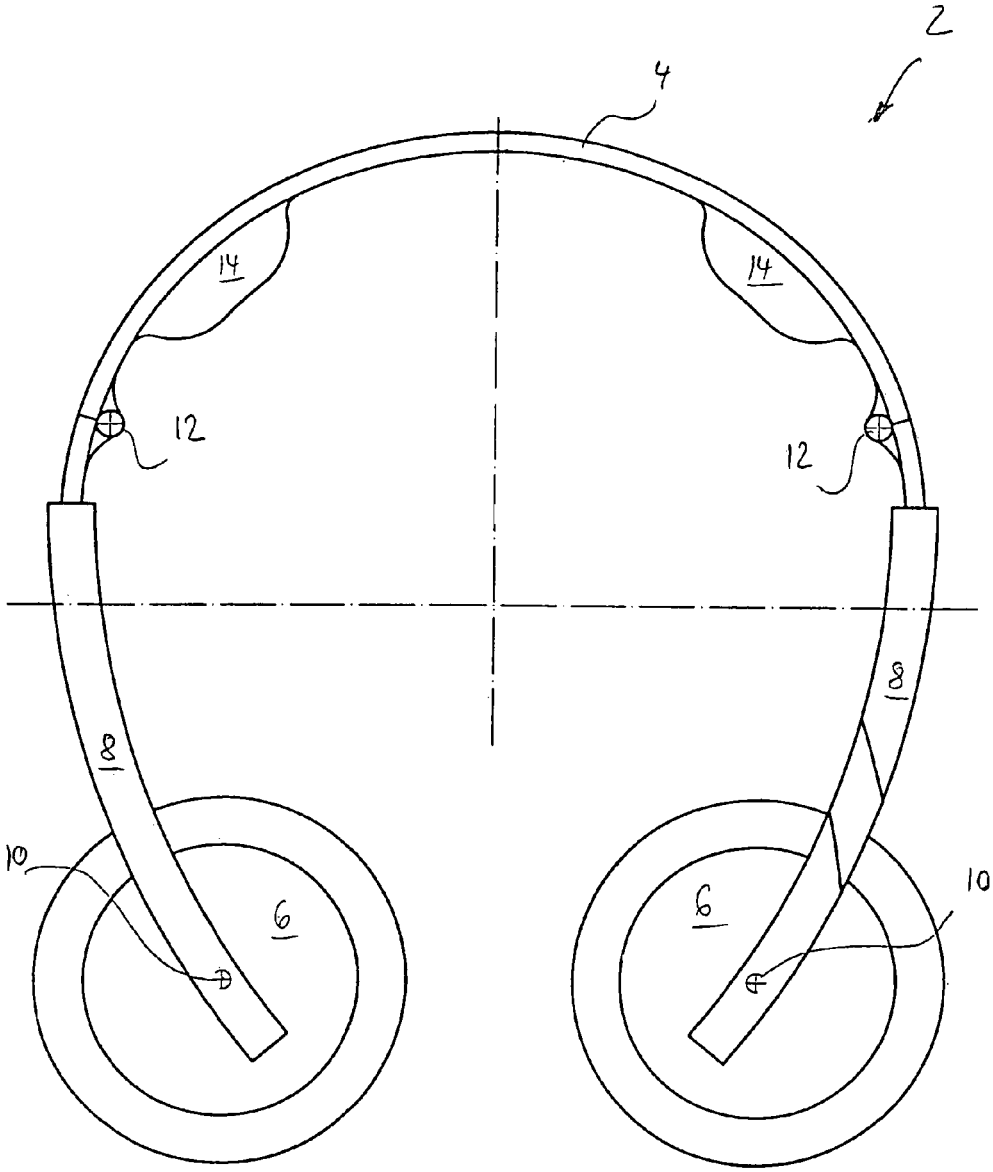
FIGS. 2 through 4 are front views successively showing the phases involved in folding the headphone set of FIG. 1 together.

Referring to FIG. 1, shown therein is a headphone set 2 comprising a hoop band 4, to each of the two ends of which is fixed a respective acoustic transducer 6. The end regions 8 together with the acoustic transducers 6 secured thereto can be telescopically retracted in and extended from the central region of the hoop band 4. The acoustic transducers 6 are mounted to the end regions 8 of the hoop band 4 by means of pivotable ball joints 10. In that way as shown in FIG. 2 they are pivotable into the plane in which the hoop band 4 extends in an arcuate configuration.

Figure 3:
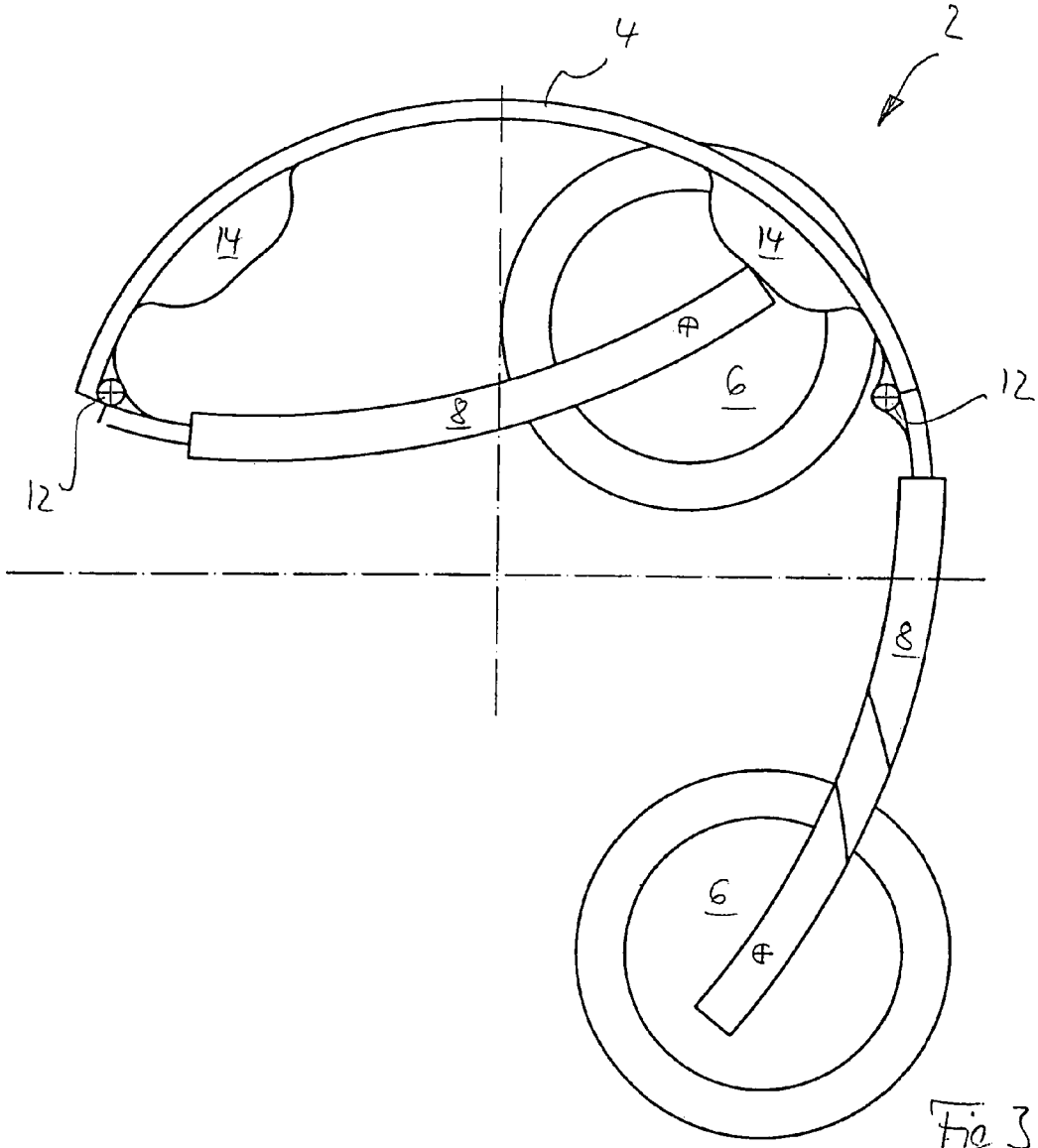

The central region of the hoop band 4 is bent from a spring sheet strip and, in the region where the hoop band 4 is approximately above the temples of the head of a user who is wearing the headphone set 2 has a respective hinge joint 12. The ends 8 of the hoop band can be folded inwardly at the hinge joints 12, as can be seen from FIGS. 3 and 4. Outward folding of the ends 8 of the hoop band in the hinge joints 12 is blocked by virtue of the fact that the hinge joints 12 are arranged at the inside on the hoop band and the hoop band portions which are thus mounted in edge-to-edge relationship form an abutment to prevent them from being folded outwardly (while they move away from each other when they are folded inwardly).

In addition, two cushions 14 can be seen on the central region of the hoop band 4 on the inward side thereof. The cushions come to bear against the temples of the head of a user and thus make it more comfortable to wear the headphone set.

Figure 4:
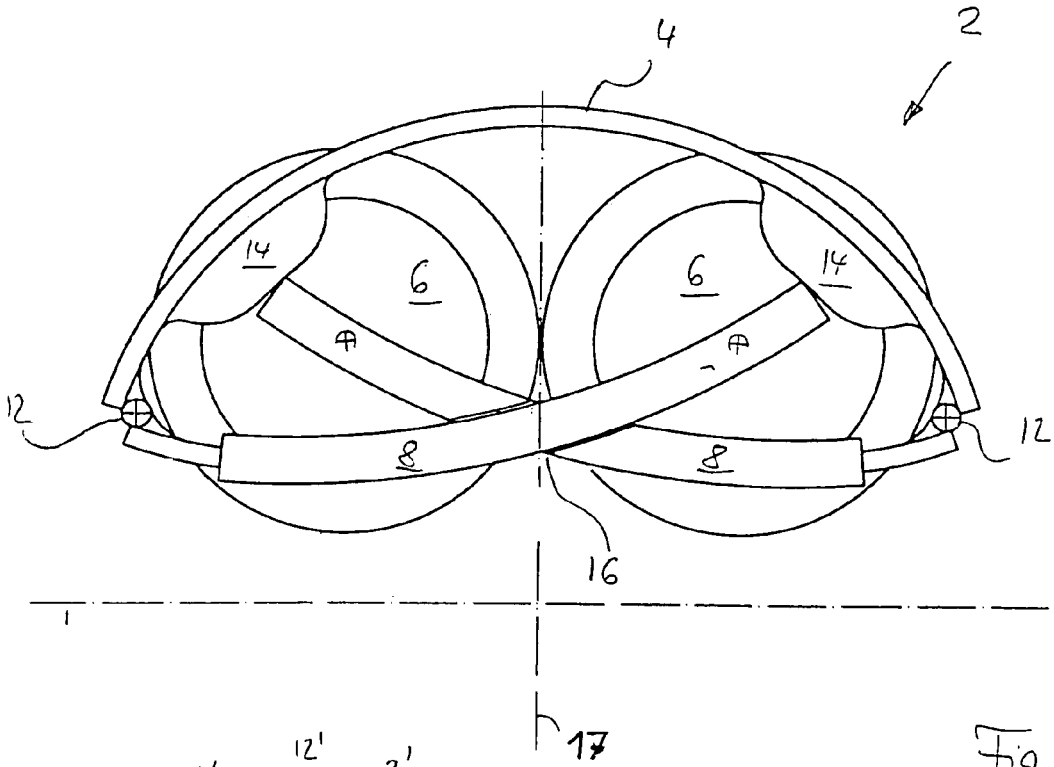

A lozenge-shaped recess 16 can be seen in the top side (the side which is visible in FIGS. 1 through 4) of the right-hand one of the ends 8 of the hoop band. Arranged in anti-symmetrical relationship, that is to say in the rear side, which is not visible, of the left-hand one of the ends 8 of the hoop band, is a corresponding identical recess 16 of complementary configuration. The sum of the depths of the two recesses corresponds to the total height of the ends 8 of the hoop band so that, when those recesses are fitted one into the other (FIG. 4), the ends of the hoop band cross over each other in mutually clasping relationship and, in that situation, in spite of the fact that they cross each other, they do not occupy a greater height than the ends 8 of the hoop band themselves. That ensures on the one hand that the headphone set 2 when in the folded-together condition as shown in FIG. 4 constitutes a particularly compactly folded unit while on the other hand this represents a connection 16 which, in mutually interengaging positive locking relationship, holds the ends of the hoop band which are clasped into each other in an inward direction in positively locking engagement. The central region of the hoop band 4 which, comprising spring sheet, is elastically deformable, is elastically biased to that position by constriction (by movement of its ends towards each other), and that causes tilting of the recesses 16 as connecting structures in the ends 8 of the hoop band and thus secures them to prevent unwanted release of that releasable connection 16.

As can be seen from FIG. 4 in accordance with the invention a headphone set 2 in the folded-together condition with transducers 6 which are pivoted into the plane of the hoop band (the plane of the drawing in FIG. 2) and hoop band ends which are held in the mutually crossed condition constitutes a flat unit with the transducers 6 being disposed in mutually juxtaposed relationship in the plane of the hoop band.

Figure 5:
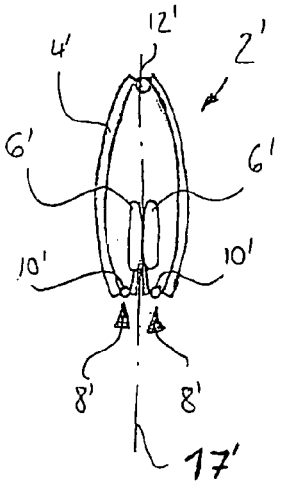
FIG. 5 is a diagrammatic front view of an alternative headphone set according to the invention.

FIG. 5 shows in an extremely diagrammatic fashion an alternative configuration of a headphone set 2' which, at the apex of its hoop band 4', has a joint 12' for folding the ends 8' of the hoop band inwardly in the plane of the hoop band (plane of the drawing in FIG. 5). In the region of the ends 8' of the hoop band each of the acoustic transducers 6' of the headphone set 2' is connected to the hoop band 4' by means of a second hinge joint 10'. Thus, as illustrated, the transducers 6' can be pivoted into the plane of symmetry 17' of the headphone set 2', where they bear in contact against each other in a space-saving condition and in that condition are protectively surrounded by the limbs of the hoop band 4', which are folded towards each other about the joint 12' at the apex of the hoop band 4'. The plane of symmetry 17' of the headphone set 2' as shown in FIG. 5 is perpendicular to the plane of the hoop band (the respective plane of the drawing), just like the plane of symmetry 17 of the headphone set 2 shown in FIGS. 1 through 4.

While the foregoing description and drawings represent the present invention, it will be obvious to those skilled in the art that various changes may be made therein without departing from the true spirit and scope of the present invention.

The invention claimed is:

1. A headphone set comprising:

a hoop band having two ends;

an acoustic transducer being fixed to each of the two ends, respectively;

said hoop band extending accurately in a plane and having at least one first joint for folding the ends of the hoop band inwardly in the plane and an elastic region for resiliently expanding and narrowing the hoop band;

wherein the one first joint for folding the ends of the hoop band inwardly is arranged at the apex of the hoop band, that the headphone set is of mirror image symmetry about a plane and that the fixing of each of the transducers to the ends of the hoop band has a second joint for pivoting the transducers relative with respect to the end of the hoop band into the plane of symmetry which is at a right angle to the plane of the hoop band and that the transducers and/or the hoop band in the region of the ends thereof each have a respective connecting structure which can be connected to each other and which then in co-operating relationship, with the ends of the hoop band folded inwardly, hold the acoustic transducers in a condition of substantially bearing against each other in the plane of symmetry wherein the transducers are protectively surrounded by limbs of the hoop band when the hoop band is folded inwardly about the first joint.

* * * * *

UNITED STATES PATENT AND TRADEMARK OFFICE

CERTIFICATE OF CORRECTION

PATENT NO. : 7,292,703 B2
APPLICATION NO. : 10/505255
DATED : November 6, 2007
INVENTOR(S) : Johannes Kaulfuss et al.

It is certified that error appears in the above-identified patent and that said Letters Patent is hereby corrected as shown below:

Title page

Title (54) change "HEADPHONES" to --HEADPHONE SET--

IN THE ABSTRACT

| | | | | | |
|---|---|---|---|---|---|
| (57) | line 3, | change | "accurately" | to | --arcuately-- |

IN THE SPECIFICATION

| | | | | | |
|---|---|---|---|---|---|
| Column 1, | lines 16-17, | change | "accurately" | to | --arcuately-- |
| | line 51, | change | "ear pieces" | to | --earpieces-- |
| | line 52, | change | "again" | to | --against-- |
| Column 2, | line 1, | change | "accurately" | to | --arcuately-- |
| | line 9, | change | "Co.-operating" | to | --co-operating-- |
| | line 15, | change | "accurately" | to | --arcuately-- |
| | line 39, | change | "Co.-operation" | to | --co-operation-- |
| Column 3, | line 13, | change | "accurately" | to | --arcuately-- |
| Column 5, | line 9, | change | "accurately" | to | --arcuately-- |

Signed and Sealed this

Twentieth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,292,703 B2
APPLICATION NO. : 10/505255
DATED : November 6, 2007
INVENTOR(S) : Johannes Kaulfuss et al.

It is certified that error appears in the above-identified patent and that said Letters Patent is hereby corrected as shown below:

Title page and Column 1, line 1

Title (54) change "HEADPHONES" to --HEADPHONE SET--

IN THE ABSTRACT

| | | | | | |
|---|---|---|---|---|---|
| (57) | line 3, | change | "accurately" | to | --arcuately-- |

IN THE SPECIFICATION

| | | | | | |
|---|---|---|---|---|---|
| Column 1, | lines 16-17, | change | "accurately" | to | --arcuately-- |
| | line 51, | change | "ear pieces" | to | --earpieces-- |
| | line 52, | change | "again" | to | --against-- |
| Column 2, | line 1, | change | "accurately" | to | --arcuately-- |
| | line 9, | change | "Co.-operating" | to | --co-operating-- |
| | line 15, | change | "accurately" | to | --arcuately-- |
| | line 39, | change | "Co.-operation" | to | --co-operation-- |
| Column 3, | line 13, | change | "accurately" | to | --arcuately-- |
| Column 5, | line 9, | change | "accurately" | to | --arcuately-- |

This certificate supersedes the Certificate of Correction issued May 20, 2008.

Signed and Sealed this

Seventeenth Day of June, 2008

JON W. DUDAS
*Director of the United States Patent and Trademark Office*